US007248000B2

(12) United States Patent
Breuer et al.

(10) Patent No.: US 7,248,000 B2
(45) Date of Patent: Jul. 24, 2007

(54) OPERATING DEVICE AND METHOD FOR OPERATING GAS DISCHARGE LAMPS

(75) Inventors: Christian Breuer, Munich (DE); Ralf Weidemann, Stahnsdorf (DE)

(73) Assignee: Patent-Treuhand-Gesellschaft für Elektrisch Glühlampen mbH, Munich (DE)

( * ) Notice: Subject to any disclaimer, the term of this patent is extended or adjusted under 35 U.S.C. 154(b) by 0 days.

(21) Appl. No.: 11/290,431

(22) Filed: Dec. 1, 2005

(65) Prior Publication Data

US 2006/0119284 A1 Jun. 8, 2006

(30) Foreign Application Priority Data

Dec. 7, 2004 (DE) ..... 10 2004 058 921

(51) Int. Cl.
*G05F 1/00* (2006.01)

(52) U.S. Cl. ..... 315/291; 315/307

(58) Field of Classification Search ..... 315/224, 315/225, 209 R, 291, 307, 312
See application file for complete search history.

(56) References Cited

U.S. PATENT DOCUMENTS 5,083,065 A 1/1992 Sakata et al. ..... 315/307
5,103,143 A 4/1992 Daub ..... 315/308
5,453,667 A * 9/1995 Matsuda et al. ..... 315/248
5,962,990 A 10/1999 Kern ..... 315/307
6,094,017 A * 7/2000 Adamson ..... 315/307
6,605,906 B2 * 8/2003 Okamoto et al. ..... 315/291
6,794,828 B2 * 9/2004 Tyson ..... 315/244
6,867,556 B2 * 3/2005 Arimoto et al. ..... 315/291
2002/0117973 A1 8/2002 Ito et al. ..... 315/307

FOREIGN PATENT DOCUMENTS

EP 0 752 806 A1 1/1997

* cited by examiner

*Primary Examiner*—Douglas W. Owens
*Assistant Examiner*—Jimmy Vu
(74) *Attorney, Agent, or Firm*—Carlo S. Bessone

(57) ABSTRACT

The invention relates to an operating device for operating high-pressure gas discharge lamps. Of particular concern is an operating device having a controller for start-up of high-pressure gas discharge lamps which provides a shorter start-up phase in comparison with the prior art. This is achieved by a lamp state detector which recognizes, after starting, that a hot lamp is present and thereupon increases the start-up current.

12 Claims, 2 Drawing Sheets

OPERATING DEVICE AND METHOD FOR OPERATING GAS DISCHARGE LAMPS

FIELD OF THE INVENTION

The invention relates to an operating device and to a method for operating high-pressure gas discharge lamps. In particular, the invention solves problems which occur during start-up of high-pressure gas discharge lamps. High-pressure gas discharge lamps will also be referred to below as lamps, for short.

BACKGROUND OF THE INVENTION

High-pressure gas discharge lamps need to be started by a high voltage which is provided by a starting device. After starting, the lamp is heated during a start-up phase from a starting temperature to an operating temperature. The voltage applied to a lamp after starting is referred to as the running voltage and is, within wide limits, not substantially dependent on the lamp current. The running voltage increases during the start-up phase from a starting running voltage to an operational running voltage. The start-up phase is followed by an operating phase in properly functioning gas discharge lamps.

In lamp technology, a distinction is drawn between high-pressure and low-pressure gas discharge lamps. With high-pressure gas discharge lamps, it is essential for operation that, during the start-up phase, the pressure in the lamp vessel increases from an initial pressure to an operating pressure. This is one reason why the invention described below can be used in a particularly advantageous manner in the case of high-pressure gas discharge lamps. However, it is also possible for it to be used in the case of low-pressure gas discharge lamps.

During the operating phase, it is conventional for the operating device to regulate the power of the lamp such that it is at a desired power. Since the running voltage is low during the start-up phase, a high lamp current is required in order to set the desired power during the start-up phase when there is power regulation alone. This current may be a multiple higher than the lamp current during the operating phase. This would lead to destruction of the electrodes of the lamp. Therefore, in the prior art, the current provided to the lamp by the operating device during the start-up phase is limited to a constant start-up current. At least during a first section of the start-up phase, the lamp is thus fed the constant start-up current. During the course of the start-up phase, the running voltage increases. If the running voltage reaches a value which, together with the constant current, produces the desired power, the power regulation begins to operate. In the event of a further increase in the running voltage, the lamp current is reduced to such an extent by the power regulation that the desired power is set. The start-up phase is concluded if the running voltage has reached the value of the operational running voltage. The operational running voltage has manufacturing tolerances and also changes during the life of a lamp. The operational running voltage is therefore defined by the running voltage which remains essentially constant at the desired power. In order to eliminate fluctuations, the running voltage is usually measured as a mean value over time. An operating lamp current correlates with the operational running voltage and, together with the operational running voltage, produces the desired power.

The following needs to be taken into account for the value of the start-up current: during the start-up phase, so much power needs to be injected into the lamp that the pressure in the lamp and thus the running voltage continuously increase until the operational running voltage has been reached. Otherwise, it may come about that the lamp remains in a stable state during the start-up phase and the desired power is not reached. In order to reliably rule out this situation, a start-up current is selected in the prior art which is markedly above the operating lamp current. This is illustrated in the specification U.S. Pat. No. 5,083,065 (Sakata). In this specification, an operating device is described which has no power regulation but the lamp current is merely set via the operating frequency. A control unit detects the increase in the running voltage throughout the start-up phase and increases the operating frequency if the increase in the running voltage is too great. The value of the lamp current is thus limited indirectly.

One aspect when selecting the start-up current is also the desire for a start-up phase which is as short as possible in order to achieve a desired luminous flux in as short a time as possible. This is achieved by a high start-up current. A high start-up current represents a severe load on the electrodes, however, which leads to damage to the electrodes and thus reduces the life of a lamp. The electrodes are damaged either by overheating, which leads to fusing and erosion, or by so-called sputtering, which is caused by ions hitting an electrode at high speed.

With operating devices according to the prior art, the start-up operation is disruptively long for many applications.

SUMMARY OF THE INVENTION

The object of the present invention is to provide an operating device for operating high-pressure gas discharge lamps and a method for controlling start-up of high-pressure gas discharge lamps, which device and method provide a start-up phase which is shorter than in the prior art.

This object is achieved by an operating device for operating high-pressure gas discharge lamps which has the following features:

- an apparatus which is suitable for triggering starting of a connected high-pressure gas discharge lamp,
- a setting device which is suitable for limiting a lamp current of connected high-pressure gas discharge lamps to a limit current value,
- a lamp state detector which is designed such that, in a time window which is shorter than the start-up phase and follows on from starting, it evaluates a running voltage of a connected high-pressure gas discharge lamp or a value proportional thereto and provides a state variable which is suitable for distinguishing between a cold and a hot high-pressure gas discharge lamp,
- a control device which inputs the limit current value to the setting device as a function of the state variable.

The object is achieved in the same way by a method for controlling the start-up of high-pressure gas discharge lamps which comprises the following steps:

- starting of a high-pressure gas discharge lamp,
- immediately after starting, the current through the high-pressure gas discharge lamp is limited to a limit current value which is suitable for cold high-pressure gas discharge lamps,
- in a time window which follows on from starting and is of shorter duration than the start-up, the voltage across the high-pressure gas discharge lamp is measured and both a value for the difference between the running voltage and a rated value and a value for the change in the running voltage over time are determined, the value for the difference and the value for the change over time are weighted and then added, thus forming a state variable, if the value of the state variable is above a comparison value, the limit current value for the current through the high-pressure gas discharge lamp is increased.

The solution according to the invention to the object given above uses the followings facts: The maximum value for the start-up current which still does not bring about any substantial damage to the electrodes is dependent on the temperature of the lamp. The lamp current during the start-up phase in an operating device according to the invention is therefore not the same each time a lamp is started. Rather, an operating device according to the invention has a lamp state detector which, during a time window at the beginning of the start-up phase, determines a state variable which is critical for the start-up current. The state variable allows the operating device to distinguish between a cold and a hot lamp. By means of a setting device, the operating device provides a low start-up current, in the case of a cold lamp, which has a value which does not significantly damage even the cold electrodes. In the case of a hot lamp, the operating device provides a high start-up current by means of the setting device which would considerably damage the cold electrodes but does not significantly damage the hot electrodes. In this manner, the start-up phase can be considerably shortened in the case of hot lamps.

This is particularly advantageous in applications in which the lamp is set in operation again after a short off-period. For example, this takes place in illumination applications which are switched frequently or in video projections in which the projector under certain circumstances is inadvertently switched off and needed again immediately.

According to the invention, the lamp state detector determines the state variable from the running voltage. The lamp state detector evaluates the running voltage in a time window following on from starting. The determination of the state variable from the running voltage can take place in various ways. For example, the lamp state detector can initially evaluate two parameters of the running voltage: the absolute value for the running voltage and the change in the running voltage over time.

The state variable can result from the evaluation of one or the other parameter. In order to obtain reliable information on the temperature of the lamp, both parameters can also be combined. A combination which can be implemented in a simple manner consists of the weighted addition of the two parameters. The result of this addition is in turn a state variable which, by comparison with a predetermined comparison value, gives information on the temperature of the lamp.

BRIEF DESCRIPTION OF THE DRAWINGS

The invention will be explained in more detail below using exemplary embodiments with reference to drawings, in which.

DETAILED DESCRIPTION OF THE INVENTION

Figure 1:
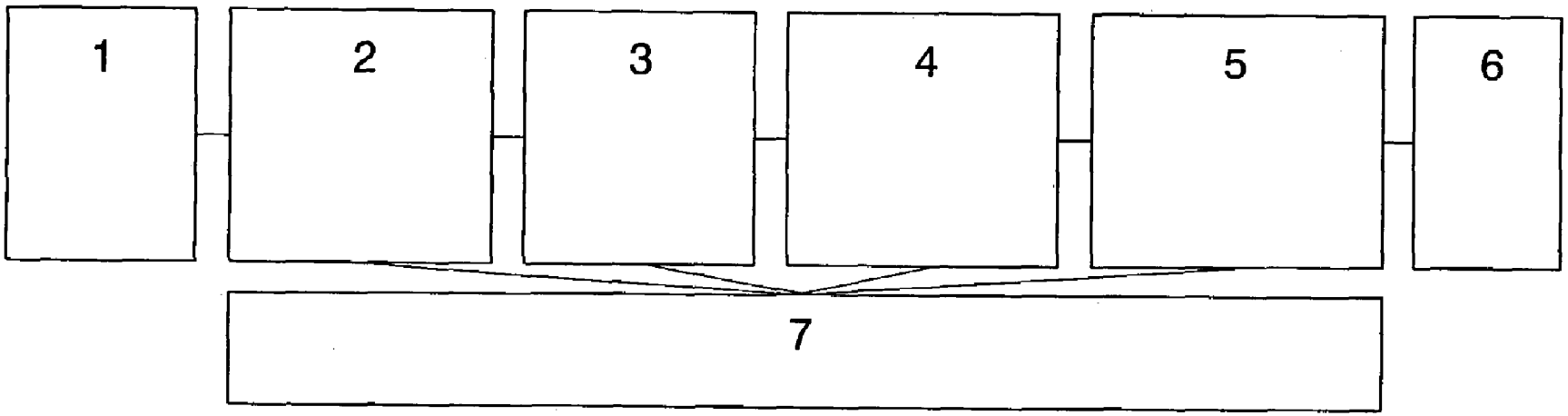
FIG. 1 shows a block circuit diagram of an exemplary embodiment of an operating device according to the invention.

FIG. 1 shows a block circuit diagram of an exemplary embodiment of an operating device according to the invention which is suitable for operating high-pressure gas discharge lamps. The fundamental design and the fundamental operation of such an operating device is described in the specification WO 95/35645 (Derra). The individual blocks will be described briefly below.

Block 1 contains a DC voltage supply, which generally draws its power from a system voltage supply. The value of the supplied DC voltage is above the running voltage of a connected lamp 6.

The DC voltage supply supplies to a step-down converter 2, which transforms the voltage value supplied by the DC voltage supply down to a value which corresponds to the running voltage of a connected lamp 6. The step-down converter 2 contains a setting device, by means of which the lamp current can be set. This takes place by selecting the voltage which is set at the output of the step-down converter.

One setting possibility is usually brought about by so-called pulse width modulation (PWM). This determines the ratio of the on duration to the off duration of electronic switches which are contained in the step-down converter 2.

The design of the step-down converter 2 can be found in the general literature relating to power electronics. WO 95/35645 (Derra) has chosen a topology having one switch. However, an embodiment with a plurality of switches is also possible, as is constituted by, for example, a half-bridge. The step-down converter 2 contains an inductor which acts as a current limiting device. The step-down converter 2 thus attains a characteristic which corresponds to a settable current source for the lamp current.

Depending on the topology selected, the step-down converter 2 provides a direct current or an alternating current. For the case in which the step-down converter 2 provides an alternating current, the output of the step-down converter 2 is fed into a rectifier 3, which provides a direct current at its output. The rectifier 3 may be dispensed with if the step-down converter 2 provides a direct current.

The direct current from the rectifier 3 or the step-down converter 2 is fed into a full-bridge 4, which converts the direct current into a square-wave alternating current. The frequency of the square-wave alternating current is low in comparison with the usual frequencies at which the step-down converter 2 operates and lies at values between 50 Hz and 1 kHz. The conversion into square-wave alternating current is necessary in applications which operate AC lamps and require a uniform luminous flux. Examples of such applications are so-called beamers and rear projection televisions. The control of the start-up of the lamp according to the invention may also be used for DC lamps or for AC lamps which are operated with a non-square-wave alternating current, however. Depending on the application, block 3 or block 4 or both may be dispensed with accordingly.

A starting unit 5 is connected between the full-bridge 4 and the lamp 6 as an apparatus which is suitable for triggering starting for a connected high-pressure gas discharge lamp. It produces the voltage necessary for starting the lamp. After starting of the lamp, the starting unit 5 generally no longer performs any function. Starting can also be provided by known resonant starting without a separate starting unit 5.

A control unit 7 is connected to the step-down converter 2, the rectifier 3, the full-bridge 4 and the starting unit 5. The control unit 7 contains the control device, a regulating device, the lamp state detector and measuring devices for detecting operational parameters (for example running voltage, lamp current) and a device for storing lamp-typical data such as rated values and comparison values for differentiating between cold and hot lamps. The individual devices are combined in the control unit 7 since the control unit 7 usually contains a microcontroller which combines the functions of two or more or all of the devices. In many cases, the implementation of a device either by hardware or by software is also possible. To an increasing extent, control and regulating tasks are taken over by software since this solution is cost-effective and flexible.

All connections which lead to the control unit 7 may be both inputs and outputs. When connected as inputs, the connections can supply information on the running voltage and on the lamp current as desired from one of the blocks 2-5 to the control unit 7.

When connected as outputs, the connections control starting, start-up, operation and disconnection of the operating device, coordinated by the control unit 7.

The regulating device, which is contained in the control unit 7, calculates the lamp power from the lamp current and the running voltage and compares it with a desired power stored for the lamp to be operated. If the lamp power is less than the desired power, the control device increases the lamp current via the setting device until the lamp power and the desired power correspond.

The lamp state detector, as described above, makes available the state variable which makes it possible to distinguish between a cold and a hot lamp.

The lamp state detector determines the state variable from the running voltage. There is a plurality of options for this. One simple option consists in the lamp state detector measuring the running voltage at a time in the time window and subtracting a rated value from this measured value. This results in a difference which forms the state variable.

In order to suppress interference, the running voltage may also be averaged over the time period of the time window and the state variable formed from the mean value.

It has been shown that the change in the running voltage over time is also well suited for deriving a state variable therefrom. In the case of cold lamps, the running voltage remains constant or is even reduced in the first seconds after starting, while, in the case of hot lamps, the running voltage increases immediately after starting. In order to determine the change in the running voltage over time in a simple manner, the lamp state detector measures an instantaneous value for the running voltage at the beginning and at the end of the time window. The difference between these two values is a measure of the change in the running voltage over time and can act as a state variable.

If a very reliable state variable is required, an instantaneous value or a mean value for the running voltage and the change in the running voltage over time can be used to determine the state variable. A simple way of combining these two characteristic values consists in weighted addition. Suitable weighting factors substantially depend on the lamp to be operated and can be determined by a series of tests.

Once the lamp state detector has determined the state variable, the control device evaluates the state variable. The result of this evaluation is critical for the input of a limit current value for the setting device. The simplest evaluation method consists in comparing the state variable with a comparison value. If the value of the state variable is above the comparison value, a hot lamp is assumed, for example, and the control device inputs a limit current value to the setting device which is suitable for a hot lamp. If the value of the state variable is below the comparison variable, a cold lamp is assumed, for example, and the control device inputs a limit current value to the setting device which is suitable for a cold lamp. Suitable values for the limit current value are dependent on the lamp to be operated and need to be determined by tests.

One more complex way of evaluating the state variable consists in the control device inputting a limit current value to the setting device which is linearly dependent on the state variable. A nonlinear dependence in the form of a characteristic is also possible. The complex evaluation makes possible a start-up phase which is as short as possible. Required proportionality factors or characteristics can be determined by tests.

Figure 2:
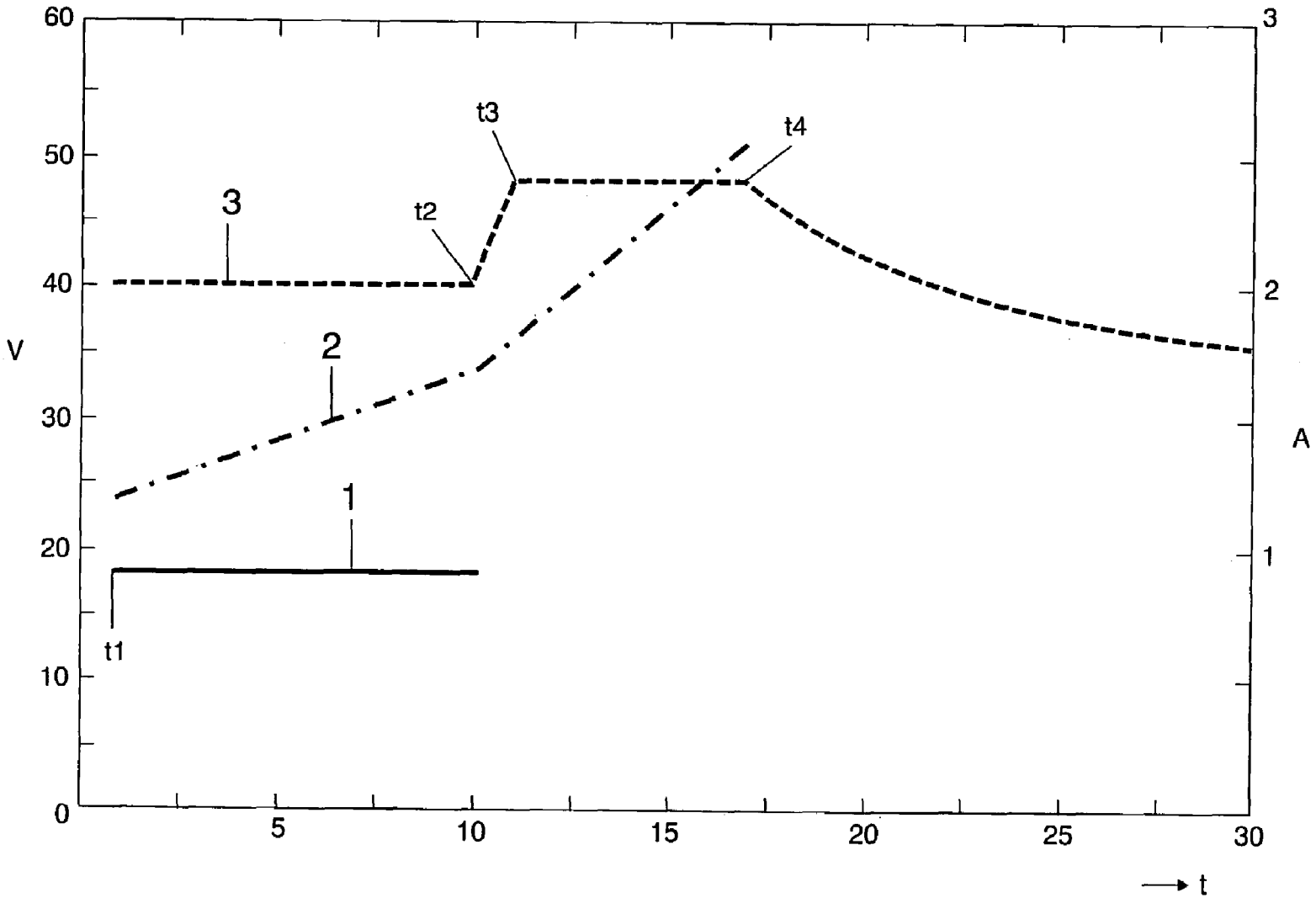
FIG. 2 shows a graph which shows the waveform of the lamp current and the running voltage.

FIG. 2 illustrates, by way of example, the waveform of the lamp current and the running voltage. The X axis forms the time axis, on which the time t is plotted in seconds. The left-hand Y axis is used for the running voltage and specifies values in volts (V). The right-hand Y axis is used for the lamp current and specifies values in amperes (A). Curve 3 shows the waveform of the lamp current and curve 2 that of the running voltage. The example illustrated in FIG. 2 shows start-up of a hot lamp. For comparison purposes, curve 1 shows the waveform of the running voltage of a cold lamp up to the end of the time window.

The example shows waveforms of a high-pressure or of a very high-pressure gas discharge lamp for projection applications having an electrical power of approximately 150 W.

At time t1, starting takes place, and the time window begins. During the time window, the setting device sets a lamp current which is suitable for cold lamps, in the example 2A. The lamp in the example was started again after 35 s and has a running voltage of 24 V at time t1. For comparison purposes, it can be seen from curve 1 that a cold lamp would have a running voltage of 18 V. If it is assumed that the rated value for the running voltage is 20 V, there is a difference of 4 volts. A simple determination of the state variable could already take place at time t1 by the difference being used as the state variable. The lamp in the example would be classified as hot, and the start-up current could be increased immediately. However, it may come about that, after ageing, some lamps have a running voltage of over 20 V even in the cold state. The example therefore shows a more complex way of determining the state variable.

The time window extends up to time t2. A cold lamp at this time would still have a running voltage of 18 V, as shown by curve 1. Curve 2 shows, however, that the running voltage of the hot lamp at time t2 has already increased to 34 V. An increase in the running voltage over time of 1.1 V/s can be calculated from this. The increase over time for hot lamps is typically over 0.7 V/s. In order to determine the state variable, the above-calculated difference and the increase over time can now be added, with a weighting. For lamps as were used in the example, the following weighting has proved favorable:

state variable=change in running voltage *70+difference *8.

A value for the state variable of 109 thus results. For comparison purposes: For the cold lamp shown by curve 1, a value for the state variable of −16 would result.

The control device evaluates the state variable at time t2. In the example, lamps having a value of the state variable of over 50 were classified as hot. The value 109 is markedly over 50. In the example, the control device thus recognizes a hot lamp and inputs a higher start-up current of 2.4 A to the setting device. This is achieved at time t3, as can be seen from curve 3. Curve 2 shows the effect of the increased start-up current on the running voltage. From time t3, the running voltage increases more quickly than previously.

At time t4, the running voltage reaches a value which, together with the start-up current, gives the predetermined rated power for the lamp. From time t4 on, the power regulation takes on the regulation of the lamp current. A further increase in the running voltage (which increase is not shown) leads to a drop in the lamp current until an equilibrium state has been set and the start-up phase is complete.

In the example, the start-up current was increased permanently by a value determined by tests of 0.4 A to a value of 2.4 A when a hot lamp was recognized. It is also possible to make this increase dependent on the value of the state variable, for example using the following formula:

start-up current=start-up current for cold lamp+additional current *(state variable −a)/b The values for a, b and the additional current need to be determined by tests. In the example, the following values have proved favorable: a=30, b=50 and additional current=0.25 A.

In the example shown in FIG. 2, the start-up phase is shortened by approximately 15 s by the start-up current being controlled according to the invention. In the example, the time window is 9 s long. However, it has been shown that a time window of 3 s is sufficient. The start-up phase can thus be shortened even further.

The invention claimed is:

1. An operating device for operating high-pressure gas discharge lamps, the operating device comprising:

an apparatus which is suitable for triggering starting of a connected high-pressure gas discharge lamp, and a setting device which is suitable for limiting a lamp current of connected high-pressure gas discharge lamps to a limit current value, characterized in that the operating device further comprises:

a lamp state detector which is designed such that, in a time window which follows on from starting and is shorter than a start-up phase, it evaluates a running voltage of a connected high-pressure gas discharge lamp or a value proportional thereto and from this derives a state variable which is suitable for distinguishing between a cold and a hot high-pressure gas discharge lamp, and a control device which inputs the limit current value to the setting device as a function of the state variable, and further characterized in that the lamp state detector contains a subtracter having two inputs and one output, the value of the running voltage at a time in the time window being applied to one input, a predetermined rated value being applied to the other input, and a difference being provided at the output of the subtracter, from which difference the lamp state detector forms the state variable.

2. The operating device as claimed in claim 1, characterized in that the lamp state detector contains an averaging unit, which provides a mean value for the running voltage within the time window at an input of the subtracter.

3. The operating device as claimed in claim 1, characterized in that the lamp state detector measures the running voltage at the start and at the end of the time window and, from the difference between these two measured values, determines a change in the running voltage over time and from this forms the state variable.

4. The operating device as claimed in claim 1, characterized in that the control device inputs a limit current value which is linearly dependent on the state variable.

5. The operating device as claimed in claim 3, characterized in that the lamp state detector uses both the difference and the change in the running voltage over time to form the state variable.

6. The operating device as claimed in claim 2, characterized in that the lamp state detector measures the running voltage at the start and at the end of the time window and, from the difference between these two measured values, determines a change in the running voltage over time and from this forms the state variable, and the lamp state detector uses both the mean value and the change in the running voltage over time to form the state variable.

7. The operating device as claimed in claim 2, characterized in that the lamp state detector forms the state variable in accordance with the following formula:

state variable=change in running voltage *70+difference *8, the change in the running voltage being measured in volts per second and the difference being measured in volts.

8. An operating device for operating high-pressure gas discharge lamps, the operating device comprising:

an apparatus which is suitable for triggering starting of a connected high-pressure gas discharge lamp, and a setting device which is suitable for limiting a lamp current of connected high-pressure gas discharge lamps to a limit current value, characterized in that the operating device further comprises:

a lamp state detector which is designed such that, in a time window which follows on from starting and is shorter than a start-up phase, it evaluates a running voltage of a connected high-pressure gas discharge lamp or a value proportional thereto and from this derives a state variable which is suitable for distinguishing between a cold and a hot high-pressure gas discharge lamp, and a control device which inputs the limit current value to the setting device as a function of the state variable, and further characterized in that the control device contains a comparator, which compares the state value with a stored comparison value, and inputs a limit current for hot lamps to the setting device if the state variable is greater than the comparison value, and inputs a limit current value for cold lamps to the setting device if the state variable is less than the comparison value.

9. The operating device as claimed in claim 8, characterized in that the lamp state detector measures the running voltage at the start and at the end of the time window and, from the difference between these two measured values, determines a change in the running voltage over time and from this forms the state variable.

10. The operating device as claimed in claim 8, characterized in that the control device inputs a limit current value which is linearly dependent on the state variable.

11. An operating device for operating high-pressure gas discharge lamps, the operating device comprising:

an apparatus which is suitable for triggering starting of a connected high-pressure gas discharge lamp, and a setting device which is suitable for limiting a lamp current of connected high-pressure gas discharge lamps to a limit current value, characterized in that the operating device further comprises:

a lamp state detector which is designed such that, in a time window which follows on from starting and is shorter than a start-up phase, it evaluates a running voltage of a connected high-pressure gas discharge lamp or a value proportional thereto and from this derives a state variable which is suitable for distinguishing between a cold and a hot high-pressure gas discharge lamp, and a control device which inputs the limit current value to the setting device as a function of the state variable, and further characterized in that the time window is shorter than 3 seconds.

12. The operating device as claimed in claim 11, characterized in that the control device contains a comparator, which compares the state value with a stored comparison value, and inputs a limit current for hot lamps to the setting device if the state variable is greater than the comparison value, and inputs a limit current value for cold lamps to the setting device if the state variable is less than the comparison value.

* * * * *